US005882245A

United States Patent [19]

Popovich et al.

[11] Patent Number: 5,882,245

[45] Date of Patent: Mar. 16, 1999

[54] POLYMER CARRIER GEARS FOR POLISHING OF FLAT OBJECTS

[75] Inventors: Dragan Popovich; John Lang Lombardi, both of Tucson; Edward Daniel Albrecht, Paradise Valley; Anthony Christopher Mulligan; Gregory John Artz, both of Tucson, all of Ariz.

[73] Assignee: Advanced Ceramics Research, Inc., Tucson, Ariz.

[21] Appl. No.: 848,921

[22] Filed: May 1, 1997

Related U.S. Application Data

[63] Continuation-in-part of Ser. No. 810,301, Feb. 28, 1997, abandoned.

[51] Int. Cl.[6] ..... B24B 7/22

[52] U.S. Cl. ..... 451/41; 451/285; 451/288; 451/398

[58] Field of Search ..... 451/41, 285, 287, 451/288, 397, 398, 402

[56] References Cited

U.S. PATENT DOCUMENTS

| | | | |
|---|---|---|---|
| 4,104,099 | 8/1978 | Scherrer | 451/346 |
| 4,239,567 | 12/1980 | Winings | 451/398 |
| 4,512,113 | 4/1985 | Budinger | 451/397 |
| 5,085,009 | 2/1992 | Kinumura et al. | 451/285 |
| 5,149,158 | 9/1992 | Molinaro et al. | 294/1.1 |
| 5,193,316 | 3/1993 | Olmstead | 451/397 |
| 5,274,960 | 1/1994 | Karlsrud . | |
| 5,329,732 | 7/1994 | Karlsrud et al. . | |

*Primary Examiner*—Eileen P. Morgan
*Attorney, Agent, or Firm*—Banner & Witcoff Ltd.

[57] ABSTRACT

A carrier is comprised of a thermoplastic polymer such as polyetheretherketone which is formed or fabricated as a uniform thickness, double sided flat sheet of material with wafer passages therethrough and gear teeth formed or fabricated around the peripheral edge thereof so as to be cooperative with a wafer polishing machine. An extrusion or rolling or calendering process provides a flat carrier which is, optionally, coated with thermoset polymer or thermoplastic film.

12 Claims, 1 Drawing Sheet

POLYMER CARRIER GEARS FOR POLISHING OF FLAT OBJECTS

CROSS REFERENCE TO A RELATED APPLICATION

This application is a continuation-in-part of application Ser. No. 08/810,301, filed Feb. 28, 1997, now abandoned.

BACKGROUND OF THE INVENTION

This invention relates to a carrier which is used as a workpiece holder in combination with a workpiece polishing apparatus. More particularly, this invention relates to flat planar carriers, made of polymeric materials, which retain or hold items for polishing metal, semiconductor materials or other substrates by appropriately positioning those materials or substrates in a polishing machine and maintaining the materials or substrates in the desired position in such a machine.

The metal or semiconductor materials which are to be polished are preferably in the form of wafers or discs which require extremely flat, polished surfaces to provide maximum useful surface area so they may be fabricated as computer or electronic components. Also, there are other fields which require wafers of metals or semiconductor materials wherein one or both surfaces of each wafer must be appropriately polished to a high degree of flatness with minimum surface distortion and imperfection.

Apparatus have been developed for polishing of wafers of this type, including wafer polishing apparatus as disclosed in U.S. Pat. No. 5,329,732 issued Jul. 19, 1994 to Karlsrud et al. for a Wafer Polishing Method and Apparatus, which patent is incorporated herewith by reference. Another apparatus of this general type used for such purposes is disclosed in U.S. Pat. No. 5,274,960 issued Jan. 4, 1994 in the name of Karlsrud for a Uniform Velocity Double Sided Finishing Machine, which patent is also incorporated herewith by reference.

In polishing apparatus of the type disclosed in the reference patents, carrier sheets or carrier gears are used to retain and position the wafers that are being polished between polishing platens. Thus, wafers, which have a nominal thickness, are retained in openings defined in flat carrier sheets. The polishing apparatus will then effect a polishing action on the surface of the wafer materials as they are retained and maintained in position in the carrier sheet. The carrier sheets or carriers may have various shapes, and the openings for retention of the wafers in the sheets may also have various shapes and/or configurations, generally congruent with shape of the wafer held by the sheet. Further, the carriers may have an outside, peripheral gear coactive with a driving gear of the polishing apparatus to thereby facilitate movement of the carriers and the wafers retained thereby during the polishing operation.

In the past, carriers were usually made from metals such as sheet steel, aluminum or thermoplastic polymers having moderate mechanical properties. Polymers such as polycarbonates, acrylics or fiber reinforced thermosetting resin such as glass fiber/epoxy, carbon fiber/epoxy or natural fiber (cotton or linen)/phenolic were used as carrier materials. A disadvantage observed in the use of metal carriers is that metal particles will abrade from the carrier or carrier gear, usually from the gear teeth of the carrier or from the surface. The particles may then cause scratching of the wafers which are being polished as they are held by the carrier.

A difficulty observed with prior art carriers made from thermoplastic polymers having moderate mechanical properties is that such polymers do not retain their shape, particularly if the carrier (carrier gear or carrier sheet) is very thin i.e. less than a millimeter, for example. This problem is exacerbated if the carrier is of a large diameter, for example, about 250 millimeters to 750 millimeters. Such polymers are also not sufficiently stiff to remain flat as a thin sheet or film and therefore may result in damage to the object or wafer which is being polished when held by such a carrier. Of course the objects being polished are typically rather thin. Thus, it is necessary to provide a thin, uniform thickness carrier having a thickness which is slightly less than the finished thickness of the object being polished.

A difficulty observed with carrier gears or carriers made from fiber reinforced thermosetting resins is that they are often brittle. Also, the reinforcement materials may be harder than the material being polished, for example if the reinforcement materials are glass or carbon fibers. In such circumstances, the reinforcement materials may abrade the wafer which is to be polished. That is, pieces of the hard materials, such as the carbon fiber, will come into contact with the wafer surface being polished and scratch that surface, causing an unsatisfactory finish.

In sum, it is a desirable and beneficial objective that such carriers be designed to retain a flat object such as a disc or wafer in a fixed position during grinding and/or polishing. Such carriers may or may not be in the form of a spur gear. Such carriers must have a high degree of strength and flexural modulus so as to appropriately hold, retain and maintain the object being polished. The carrier or carrier gear should also be comprised of materials which will not flake, shred or shard or otherwise interfere with the polishing activity or action. These objectives, among others, inspired the development of carrier gear construction disclosed and claimed.

SUMMARY OF THE INVENTION

In a principal aspect, the present invention comprises a carrier for use as a workpiece holder in combination with polishing apparatus. The carrier includes an extruded uniform thickness sheet of a thermoplastic polymer material selected from the group consisting of polyetheretherketone, polyaryletherketone, polyetherimide, polyimide, polyethersulfone, polyamide-imide, polyethylene terephthalate, polybutylene terephthalate, acetal homopolymer, acetal copolymer, and liquid crystal polymer. Preferably, the carrier is formed with peripheral sprocket teeth for coaction with a wafer polishing apparatus or machine, and the carrier typically includes at least one shaped passage for receipt and holding a workpiece in the form of a disc or wafer, for example. The carrier may be coated on one or both sides with a layer of the thermosetting resin selected from a group consisting of epoxy, epoxy-acrylic mixture, urethane-acrylic mixture, and epoxy-acrylic-urethane mixture. The invention also contemplates a method of polishing utilizing a carrier of the type described.

Thus, it is an object of the invention to provide an improved carrier which may be used in combination with workpiece and wafer polishing apparatus.

It is a further object of the invention to provide an improved carrier manufactured by extrusion or rolling or calendering methods and formed or fabricated as a thin, uniform thickness sheet having a high degree of strength and capable of flexing while still maintaining a wafer or disc in a fixed position between polishing platens of a wafer polishing apparatus.

Yet another object of the invention is to provide an improved carrier which may be in the form of a gear for use in a wafer polishing apparatus.

Yet a further object of the invention is to provide an improved carrier made from an acid and base tolerant material wherein one or both sides of the flat material may be coated with epoxy or other organic or inorganic coating materials.

It is a further object of the invention to provide an improved carrier which does not easily scratch, flake or abrade so as to be the source of debris which will interfere with a wafer polishing operation.

Yet another object of the invention is to provide an improved carrier wherein the use of an abrasive slurry in combination with the carrier material to polish an object or wafer retained by the carrier will not abrade or degrade the wafer.

Yet a further object of the invention is to provide a carrier made from a single phase material which is preferably softer than the material being polished yet strong enough so that it is not necessary to enhance the mechanical properties of the carrier by adding reinforcing material such as fiber materials which constitute a different phase material in the carrier.

Yet a further object of the invention is to provide an improved carrier which has a long life relative to prior art carriers, which is inexpensive relative to prior art carriers and which may be manufactured and used with a minimum of difficulty.

These and other objects advantages and features of the invention will be set forth in the detailed description which follows.

THE DESCRIPTION OF THE DRAWING

In the detailed description which is follows reference will be made to the drawing comprising the following figures.

DESCRIPTION OF THE PREFERRED EMBODIMENT

Figure 1:
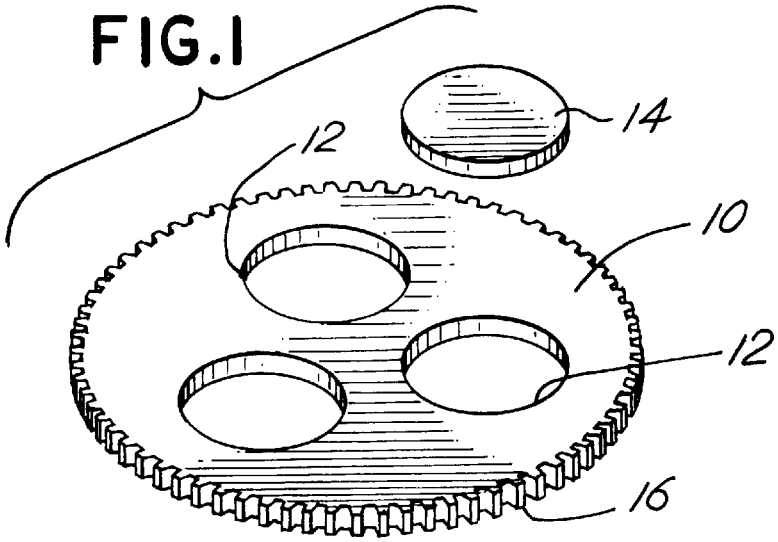
FIG. 1 is perspective view of a typical carrier or carrier gear made in accord with the invention.
Figure 2:
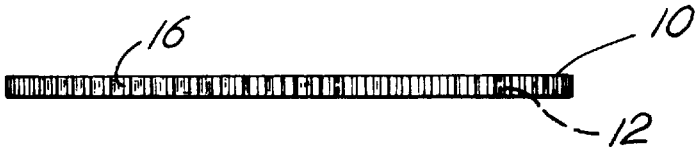
FIG. 2 is side elevation of the carrier of FIG. 1.
Figure 3:
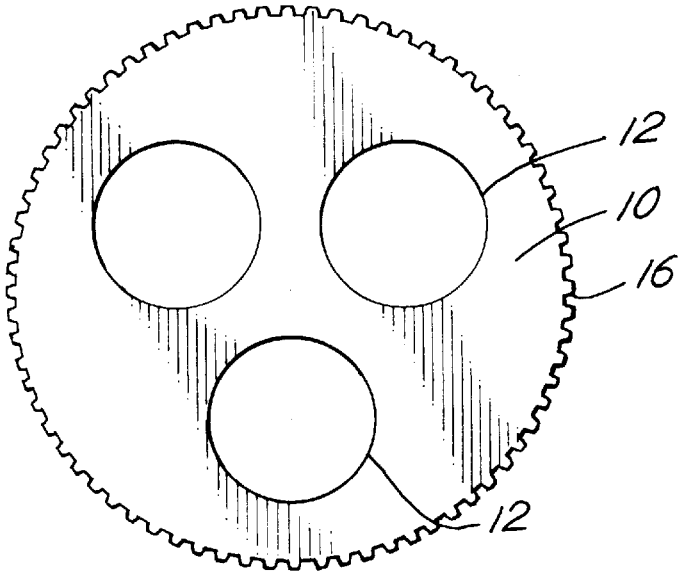
FIG. 3 is a top plan view of the carrier of FIG. 1.

The carrier or carrier gears of the invention are made from an extruded or rolled or calendered sheet of selected thermoplastic, polymer material. When formed as extruded material, the material is extruded or calendered in the form of a thin, flat, uniform thickness sheet. It is important that the extruded sheet be manufactured from a selected material which has sufficient flexural modulus so that it does not buckle or fracture when used as a carrier in a polishing machine. It has been found that the group of selected materials consisting essentially of high performance engineering thermoplastics such as polyetheretherketone (PEEK), polyetheramideketone (PEAK), polyaryletherkepone (PAEK), polyetherimide (PEI), polyimide (PI), polyethersulfone (PES), polysulfone (PS), polyamide-imide (PAI), polyethelene terephthalate (PET), polybutylene terephthalate (PBT), acetal homopolymer, acetal copolymer, liquid crystal polymer (LCP), and similar polymers have sufficiently high flexural moduli to remain flat when formed into thin sheets by an extrusion process. Such sheets are then cut so as to have openings to retain the wafers or materials which are to be polished, and optionally include peripheral or external gear teeth to coact with and be driven by polishing apparatus to thereby effect polishing of the wafers. The select high performance engineering thermoplastics also have a sufficiently high strength to withstand mechanical loads, particularly with respect to the carrier gear teeth without degrading or abrading during the wafer polishing operation.

Further the listed polymers are sufficiently chemically inert to avoid any reaction in water, moderately acidic or basic environments, or with organic solvents. Also, the polymers do not need fibers or particulate reinforcement to improve their strength. Elimination of such fibers or similar materials eliminates the problem of abrasive debris. Thus, the carrier gears or carriers made from the select polymers listed do not contain any second phases which are harder than the objects being polished. There is no creation of debris which will inadvertently cause undesirable scratching of the wafer or item being polished.

Referring to the drawing, an extruded rolled or calendered sheet of select thermoplastic polymer is formed as a carrier 10 with a thickness in the range of about 0.1 millimeters up to about 5 millimeters. The carrier 10 is formed or fabricated with a series of openings 12 for retention of discs or wafers 14 within the openings 12. Note, wafer 14 will have a size and shape which is generally congruent with the size and shape of the opening 12. The external periphery of the carrier 10 is formed with gear teeth 16 which coact with drive gears (not shown) of the polishing machine; for example, polishing machines of the type referenced herein. Following is a series of examples of the invention and experiments relating to the invention:

EXAMPLES:

Example 1

An 0.6 mm thick sheet of extruded polyetheretherketone (PEEK) is formed or fabricated into a carrier gear, having the diameter of about 230 mm, involute teeth on the perimeter, and three 95 mm diameter holes through the carrier gear. The surface of the carrier gear is in an "as is" state, i.e. same as the surface of the extruded PEEK sheet. Three aluminum discs, having a thickness of 0.75 mm and a diameter of 95 mm each, are placed into the congruent holes on the carrier gear. The carrier and discs are placed in a polishing machine. A low-intensity polishing cycle is started, characterized by soft and more compliant polishing pad, such as Rodel Politex HI, and finer particle size of the abrasive slurry. A SpeedFam Model 9B-14P double sided polishing machine is used with both low and high settings at up to 50 rpm rotational velocity and about 300–350 kg downforce on the pad. Upon completion of the polishing cycle, the aluminum discs are examined, and the surface finish is found to be satisfactory. Then a new set of aluminum discs is placed into the carrier gear, and a high-intensity polishing cycle is started, characterized by hard and less compliant polishing pad, such as Rodel Suba 550, and coarser particle size of the abrasive slurry. Upon completion of the polishing cycle, the aluminum discs are examined, and the surface finish is found to be satisfactory on the top side of the aluminum discs, but containing scratches, and therefore unacceptable, on the bottom side of the aluminum discs.

Example 2

A PEEK carrier gear is formed or fabricated according to the Example (1). The surface of the carrier gear is modified by polishing both sides of the carrier gear with a submicron-sized abrasive particulate slurry described as any of the family of Fujimi Alumina slurries. Aluminum discs are placed into the carrier gear and low-and high-intensity polishing cycles are repeated as described in the Example (1). Upon completion of the low-intensity polishing cycle, the aluminum discs are examined, and the surface finish is found to be satisfactory. Upon completion of the high-intensity polishing cycle, the aluminum discs are examined, and the surface finish is found to be satisfactory on the top side of the aluminum discs, but containing scratches, and therefore unacceptable, on the bottom side of the aluminum discs. The bottom side of aluminum discs is found to contain fewer number of scratches than after the similar experiment described in the Example (1).

Example 3

A PEEK carrier gear is formed or fabricated according to the Example (1). The surface of the carrier gear is modified by buffing both sides of the carrier gear with a cotton buffing wheel. Aluminum discs are placed into the carrier for and low-and high-intensity polishing cycles are repeated as described in the Example (1). Upon completion of the low-intensity polishing cycle, the aluminum discs are examined, and the surface finish is found to be satisfactory. Upon completion of the high-intensity polishing cycle, the aluminum discs are examined, and the surface finish is found to be satisfactory on the top side of the aluminum discs, but containing scratches, and therefore unacceptable, on the bottom side of the aluminum discs. The bottom side of the aluminum discs is found to contain fewer number of scratches than after the similar experiment described in the Example (2).

Example 4

A PEEK carrier gear is formed or fabricated according to the Example (1). The surface of the carrier gear is modified by sanding both sides of the carrier gear with a 400 grit sand paper followed by sanding both sides of the carrier gear with a 1000 grit sand paper. Aluminum discs are placed into the carrier gear and low-and high-intensity polishing cycles are repeated as described in the Example (1). Upon completion of the low-intensity polishing cycle, the aluminum discs are examined, and the surface finish is found to be satisfactory. Upon completion of the highintensity polishing cycle, the aluminum discs are examined, and the surface finish is found to be satisfactory on the top side of the aluminum discs, but containing scratches, and therefore unacceptable on the bottom side of the aluminum discs. The bottom side of aluminum discs is found to contain fewer number of scratches than after the similar experiment described in the Example (3).

Example 5

A PEEK carrier gear if formed or fabricated according to the Example (1). The surface of the carrier gear is modified by coating both sides of the gear with a very thin layer (less than 0.006 mm) of thermosetting resin, such as epoxy, epoxy/acrylate mixtures, urethane/acrylate mixtures, epoxy/urethane/acrylate mixtures, and the like, and then curing the resin completely. Specifically, the following coating is applied: BASF R-M Diamont DC92 clearcoat with DH42 hardener. Aluminum discs are placed into the carrier gear and low and high-intensity polishing cycles are repeated as described in the Example (1). Upon completion of the low-intensity polishing cycle, the aluminum discs are examined, and the surface finish is found to be satisfactory. Upon completion of the high-intensity polishing cycle, the aluminum discs are examined, and the surface finish is found to be satisfactory on both sides of the aluminum discs, containing no scratches observed in Examples (1–4).

Example 6

The surface of a 0.5 mm thick sheet of polyetheretherketone (PEEK) is modified by coating both sides of the sheet first with a thin layer of adhesion promoter such as members of amine or silane family (specifically; BASF R-M 864), and then with a 0.05 mm thick layer of a thermosetting resin, such as epoxy, epoxy/acrylate mixtures, urethane/acrylate mixtures, epoxy/urethane/acrylate mixtures, and the like, and then curing the resin completely. Specifically, the following is applied: BASF R-M Diamont DC92 clearcoat with DH42 hardener. The surface-modified sheet is then formed or fabricated into a carrier gear, having the diameter of about 230 mm, involute teeth on the perimeter, and three 95 mm diameter holes through the surface of the carrier gear. Aluminum discs are placed into the carrier and low- and high-intensity polishing cycles are repeated as described in the Example (1). Upon completion of the low-intensity polishing cycle, the aluminum discs are examined, and the surface finish is found to be satisfactory. Upon completion of the high-intensity polishing cycle, the aluminum discs are examined, and the surface finish is found to be satisfactory on both sides of the aluminum discs, containing no scratches observed in Examples (1–4). It is also observed that the thermosetting resin coating adheres to the surface of the PEEK carrier gear better than in the Example (5) mentioned above, and that it is possible to use the carrier prepared according to the Example (6) for a greater number of identical polishing cycles than the carrier gear prepared according to the Example (5) before the thermosetting resin coating starts to wear off and adversely affect the polishing action. The comparative number of cycles is as follows: For each of the Examples six (6) through ten (10), the respective number of polishing cycles is ten or more percent higher than the number of polishing cycles for Example five (5)

Example 7

The surface of a 0.5 mm thick sheet of polyetheretherketone (PEEK) is modified by exposing both surfaces of the sheet to plasma etching or corona discharge thereby oxidizing the surface, and then coating both sides of the sheet with a 0.05 mm thick layer of a thermosetting resin, such as epoxy, epoxy/acrylate mixtures, urethane/acrylate mixtures, epoxy/urethane/acrylate mixtures, and the like, and then curing the resin completely. Specifically, the following coating is used: BASF R-M Diamont DC92 clearcoat with DH42 hardener. The surface-modified sheet is then formed or fabricated into a carrier gear according to the Example (6). Aluminum discs are placed into the carrier gear and low- and high-intensity polishing cycles are repeated as described in the Example (1). Upon completion of the low-intensity polishing cycle, the aluminum discs are examined, and the surface finish is found to be satisfactory. Upon completion of the high-intensity polishing cycle, the aluminum discs are examined, and the surface finish is found to be satisfactory on both sides of the aluminum discs, containing no scratches observed in Examples (1–4). It is also observed that the thermosetting resin coating adheres to the surface of the PEEK carrier gear better than in the Example (5) mentioned above, and that it is possible to use the carrier prepared according to the Example (7) for a greater number of identical polishing cycles than the carrier gear prepared according to the Example (5) before the thermosetting resin coating starts to wear off and adversely affect the polishing action.

Example 8

The surface of a 0.5 mm thick sheet of polyetheretherketone (PEEK) is modified by coating both sides of the sheet first with a thin layer of adhesion promoter such as members of amine or silane family (specifically: BASF R-M 864), and then warm laminating a 0.05 mm thick film of polyethylene terephthalate (specifically: GBC Nap Lam II) to both sides of the sheet coated with adhesion promoter so that the surface of the PEEK sheet is completely covered with the laminated film. The surface-modified sheet is then formed or fabricated into a carrier gear according to the Example (6). Aluminum discs are placed into the carrier gear and low- and high-intensity polishing cycles are repeated as described in the Example (1). Upon completion of the low-intensity polishing cycle, the aluminum discs are examined, and the surface finish is found to be satisfactory. Upon completion of the high-intensity polishing cycle, the aluminum discs are examined, and the surface finish is found to be satisfactory on both sides of the aluminum discs, containing no scratches observed in Examples (1–4). It is also observed that the laminated film adheres well to the surface of the PEEK carrier gear, and that it is possible to use the carrier prepared according to the Example (8) for a greater number of identical polishing cycles than the carrier gear prepared according to the Example (5) before the laminated film starts to wear off and adversely affects the polishing action.

Example 9

The surface of a 0.5 mm thick sheet of polyetheretherketone (PEEK) is modified by coating both sides of the sheet first with a thin layer of adhesion promoter such as members of amine or silane family (specifically: BASF R-M 864), and then a geometrical pattern such as lines, dots, or figures is printed or applied onto both surfaces of the sheet (in this case crosshatch squares pattern). Following this, both sides of the sheet are coated with a 0.05 mm thick layer of a thermosetting resin, such as epoxy, epoxy/acrylate mixtures, urethane/acrylate mixtures, epoxy/urethane/acrylate mixtures, and the like (m this case BASF R-M Diamont DC92 clearcoat with DH42 hardener), and then curing the resin completely. The surface-modified sheet is then formed or fabricated into a carrier gear according to the Example (6). Aluminum discs are placed into the carrier gear and low- and high-intensity polishing cycles are repeated as described in the Example (1). Upon completion of the low-intensity polishing cycle, the aluminum discs are examined, and the surface finish is found to be satisfactory. Upon completion of the high-intensity polishing cycle, the aluminum discs are examined, and the surface finish is found to be satisfactory on both sides of the aluminum discs, containing no scratches observed in Examples (1–4). It is also observed that the thermosetting resin coating adheres to the surface of the PEEK carrier gear better than in the Example (5) mentioned above, and that it is possible to use the carrier prepared according to the Example (9) for a greater number of identical polishing cycles than the carrier gear prepared according to the Example (5) before the thermosetting resin coating starts to wear off and adversely affect the polishing action. It is further observed that after the thermosetting coating is worn off throughout its thickness either locally or on the whole surface of the carrier, the geometrical pattern starts to wear out at those spots before wear reaches the surface of the PEEK, thereby providing a simple method for visual inspection of the integrity of the coating. It is therefore possible to see, by observing wear spots in the geometrical pattern, when the worn out carriers need to be replaced with new ones without removing them from the polishing machine and having to measure carrier thickness with an appropriate tool.

Example 10

The surface of a 0.5 mm thick sheet of polyetheretherketone (PEEK) is modified by coating both sides of the sheet first with a think layer of adhesion promoter such as members of amine or silane family (specifically: BASF R-M 864), and then a geometrical pattern such as lines, dots, or figures (in this case crosshatch squares pattern) is printed or applied onto both surfaces of the sheet. Following this, a 0.05 mm thick film of polyehtylene terephthalate (specifically: GBC Nap Lam II) is warm laminated to both sides of the sheet coated with adhesion promoter so that the surface of the PEEK sheet is completely covered with the laminated film. The surface-modified sheet is then formed or fabricated into a carrier gear according to the Example (6). Aluminum discs are placed into the carrier gear and low- and high-intensity polishing cycles are repeated as described in the Example (1). Upon completion of the low-intensity polishing cycle, the aluminum discs are examined, and the surface finish is found to be satisfactory. Upon completion of the high-intensity polishing cycle, the aluminum discs are examined, and the surface finish is found to be satisfactory on both sides of the aluminum discs, containing no scratches observed in Examples (1–4). It is also observed that the laminated film adheres well to the surface of the PEEK carrier gear, and that it is possible to use the carrier prepared according to the Example (10) for a greater number of identical polishing cycles than the carrier gear prepared according to the Example (5) before the laminated film starts to wear off and adversely affect the polishing action. It is further observed that after the laminated film is worn off throughout its thickness either locally or on the whole surface of the carrier, the geometrical pattern starts to wear out at those spots before wear reaches the surface of the PEEK, thereby providing a simple method for visual inspection of the integrity of the laminated film. By observing wear spots in the geometrical pattern, worn out carriers can be identified without removing them from the polishing machine or measuring carrier thickness with an appropriate tool.

Following are general characteristics desired in the single phase sheet of material which is used to make a carrier:

Tensile strength at break of at least 8,000 psi (ASTM D638);

Elongation at break of at least 10% (ASTM D638);

Flexural modulus of at least 300,000 psi (ASTM D790);

Water absorption of less than 2.2% at saturation (ASTM D570).

Range of molecular weights of polymers - 10,000–200,000

The following table references the general characteristics of materials which may be used to make the carriers:

| Polymer | Tensile Strength at Break, psi | Elongation at Break, % | Flexural Modulus, $10^3$ psi | Water Absorption, % |
|---|---|---|---|---|
| PEEK | 10200–15000 | 30–150 | 560 | 0.5 |
| PAEK | 13500 | 50 | 530 | 0.8 |
| PI | 10500–17100 | 7.5–90 | 360–500 | 1.2 |
| PEI | 14000 | 60 | 480 | 1.25 |
| PES | 13000 | 15–40 | 370 | 2.1 |
| PAI | 22000 | 15 | 730 | 0.33 |
| PET | 7000–10500 | 30–300 | 350–450 | 0.2–0.3 |
| PBT | 8200–8700 | 50–300 | 330–400 | 0.4–0.5 |
| Acetal homopolymer | 9700–10000 | 10–75 | 380–490 | 1 |
| Acetal copolymer | 8800–10150 | 15–75 | 370–450 | 0.8 |
| LCP | 15900–27000 | 1.3–4.5 | 1770–2700 | 0.1 |

As can be seen from the table and the examples, formation or fabrication of the specific materials into an appropriate carrier either with or without a surface coating is an important factor associated with the invention. Coatings and thin layer films for the carriers are defined in the examples, and the coatings or films may be varied. Nonetheless, various changes may be made with respect to the invention. For example, the materials may be composed of mixed polymers as long as there is a single phase of the sheet material being utilized. The shape and configuration of the carrier is variable. Thus, while there has been set forth preferred embodiments of the invention, the invention is limited only by the following claims and their equivalents.

It is claimed:

1. A carrier gear for use in combination with a polishing apparatus as a workpiece holder, said carrier gear comprising in combination:

an extruded or rolled, or calendered, uniform thickness, single layer sheet of a thermoplastic polymer material selected from the group consisting of polyetheretherketone, polyaryletherketone, polyetherimide, polyimide, polyether sulfone, polyamide-imide, polyethylene terephthalate, polybutylene terephthalate, acetal homopolymer, acetal copolymer, and liquid crystal polymer, said sheet formed with means for coaction with a wafer polishing apparatus and further including at least one shaped passage in the sheet for a congruent workpiece said polymer material having a tensile strength at break of at least about 8,000 psi.

2. The carrier gear of claim 1 in combination with a wafer polishing apparatus.

3. The carrier gear of claim 1 wherein the sheet has a thickness greater than about 0.1 mm.

4. The carrier gear of claim 2 wherein the sheet is coated on both sides with a layer selected from the group consisting of cured thermosetting resin, organic coating and inorganic coating.

5. The carrier gear of claim 4 wherein the resin is a resin selected from the group consisting of epoxy, an epoxy/acrylate mixture, an urethane/acrylate mixture, and an epoxy/acrylate/urethane mixture.

6. The carrier gear of claim 1 wherein the carrier is fabricated from a sheet of polyetheretherketone.

7. The carrier gear of claim 1 wherein the means for coaction comprise peripheral sprocket teeth formed in the carrier gear.

8. The carrier gear of claim 1 in combination with a plastic film coating on at least one side of the carrier gear.

9. A method for polishing the opposite surfaces of a thin wafer of material comprising, in combination, the steps of:

placing the wafer in a congruent shaped holding passage defined through a carrier gear of the type comprising a sheet of single layer, uniform thickness thermoplastic polymer with means for coaction with a wafer polishing apparatus said polymer having a tensile strength at break of at least about 8,000 psi;

positioning the wafer and carrier gear in a polishing apparatus of the type having platens on opposite sides of the carrier gear in opposed relation to the wafer;

injecting a polishing slurry to cover the wafer; and driving the carrier gear between the platens to polish the wafer.

10. The method of claim 9 wherein the carrier gear is an extruded or rolled or calendered sheet of thermoplastic polymer material selected from the group consisting of polyetheretherketone, polyaryletherketone, polyetherimide, polyimide, polyether sulfone, polyamideimide, polyethylene terephthalate, polybutylene terephthalate, acetal homopolymer, acetal copolymer, and liquid crystal polymer.

11. The method of claim 9 wherein the carrier gear is an extruded or rolled or calendered sheet of polyetheretherketone thermoplastic polymer.

12. The method of claim 10 wherein the carrier gear sheet is coated on both sides with a layer of cured thermosetting resin from the group consisting of epoxy, an epoxy/acrylate mixture, an urethane/acrylate mixture, an epoxy/acrylate/urethane mixture, a plastic film and combinations thereof.

* * * * *